US005809802A

United States Patent [19]

Rathbone

[11] Patent Number: 5,809,802

[45] Date of Patent: Sep. 22, 1998

[54] AIR SEPERATION

[75] Inventor: Thomas Rathbone, Surrey, England

[73] Assignee: The BOC Group plc, Wndlesham Surrey, England

[21] Appl. No.: 814,559

[22] Filed: Mar. 11, 1997

[30] Foreign Application Priority Data

Mar. 12, 1996 [GB] United Kingdom ..... 9605171

[51] Int. Cl.[6] ..... F25J 1/00

[52] U.S. Cl. ..... 62/646; 62/924

[58] Field of Search ..... 62/649, 924

[56] References Cited

U.S. PATENT DOCUMENTS 5,100,447 3/1992 Krishnamurthy et al. ..... 62/924

5,440,884 8/1995 Bonaquist ..... 62/924

5,522,224 6/1996 Chaney ..... 62/656

*Primary Examiner*—Ronald C. Capossela

*Attorney, Agent, or Firm*—David M. Rosenblum; Salvatore P. Pace

[57] ABSTRACT

An air separation method and apparatus in which a flow of air is subjected to a first rectification so as to separate therefrom an oxygen fraction and a nitrogen fraction. An argon-containing stream comprising argon, oxygen, and, as an impurity, nitrogen is withdrawn from the first rectification and is subjected to a second rectification so as to separate an impure argon fraction containing nitrogen. Nitrogen impurity is stripped from a stream of the argon fraction in a stripping column. A stream of sub-cooled liquid cools a condenser associated with an upper region of the stripping column by indirect heat exchange with condensing argon-nitrogen vapor mixture, and passes out of said indirect heat exchange still in sub-cooled state.

10 Claims, 2 Drawing Sheets

AIR SEPERATION

BACKGROUND OF THE INVENTION

This invention relates to a method and apparatus for separating air.

Separation of air by rectification is well known. In one such method and apparatus for separating air there are performed the steps of subjecting the flow of air to a first rectification and thereby separating an oxygen fraction and a nitrogen fraction from the air, withdrawing from the first rectification an argon-containing stream comprising argon, oxygen and, as an impurity, nitrogen, and subjecting the argon-containing stream to a second rectification, and thereby separating from it an argon fraction. The first rectification is typically performed in a double rectification column which comprises a higher pressure rectification column, a lower pressure rectification column, and a condenser-reboiler placing the top of the higher pressure rectification column in heat exchange relationship with the bottom of the lower pressure rectification column. Air is separated in the higher pressure rectification column into nitrogen vapour and oxygen-enriched liquid. The nitrogen vapour is condensed in the condenser-reboiler and as a result reflux is formed for both the higher and the lower pressure rectification columns. The oxygen-enriched liquid air is separated in the lower pressure rectification column into oxygen and nitrogen.

The argon-containing stream is typically withdrawn from the lower pressure rectification column at a region thereof where the argon concentration is typically in the range of 5 to 15% by volume. Separation of the argon from the oxygen is performed in a further rectification column or columns. As disclosed in EP-A-0 377 117, if a low pressure drop packing is employed to contact ascending vapour with descending liquid in the further rectification column, a complete separation of argon from oxygen can be achieved.

The resulting argon does, however, still contain some traces of nitrogen impurity, typically in the order of 10 to 200 parts per million by volume. EP-A-0 377 117 discloses a yet further column for the purpose of stripping the nitrogen impurity out of the argon. The column is reboiled and condensed by means of a stream of nitrogen vapour taken from the higher pressure column. The nitrogen vapour is condensed in a reboiler associated with the bottom region of the stripping column. A separate stream of liquid nitrogen is withdrawn from the higher pressure rectification column and is passed through a Joule-Thomson valve. The resulting stream of liquid nitrogen is combined with a stream of condensate from the reboiler associated with the stripping column. The combined stream flows to a condenser associated at the top region for stripping column and thereby provides cooling for this condenser. As a result, nitrogen is vaporised. The nitrogen vapour is mixed with a gaseous nitrogen product withdrawn from the top of the lower pressure rectification column. As a result, the lower pressure rectification column receives a reduced amount of liquid nitrogen reflux. It is therefore desirable to use an alternative source of fluid for cooling the condenser associated with the stripping column. EP-A-0 669 509 discloses employing oxygen-enriched liquid from the higher pressure rectification column as a source of cooling for the condenser associated with the top of the stripping column. The oxygen-enriched liquid is thereby vaporised. The condenser is partially immersed in a bath of the oxygen-enriched liquid. It is often desirable to avoid using such a bath.

There is therefore a need for a method and apparatus which enables a condenser associated with an upper region of the stripping column be cooled other than by means of a bath of the oxygen-enriched liquid.

SUMMARY OF THE INVENTION

According to the present invention there is provided a method of separating air, comprising subjecting a flow of air to a first rectification and thereby separating an oxygen fraction and a nitrogen fraction from the air; withdrawing from the first rectification an argon-containing stream comprising argon, oxygen, and, as an impurity, nitrogen; subjecting the argon-containing stream to a second rectification and thereby separating from it an impure argon fraction containing nitrogen; and stripping nitrogen impurity from a stream of the argon fraction in a stripping column, wherein a stream of sub-cooled liquid cools a condenser associated with an upper region of the stripping column by indirect heat exchange with condensing argon-nitrogen vapour mixture, and passes out of said indirect heat exchange still in sub-cooled state.

The invention also provides apparatus for separating air, comprising a first rectification column or columns for separating a flow of air into an oxygen fraction and nitrogen fraction; an outlet from the first rectification column or columns for an argon-containing stream comprising argon, oxygen and, as an impurity, nitrogen, communicating a second rectification column or columns for separating from the argon-containing stream an impure argon fraction containing nitrogen; a stripping column for stripping nitrogen impurity from a stream of the impure argon fraction, having a condenser associated with an upper region of the stripping column, and a flow path through the condenser for a stream of sub-cooled liquid extending from a source of the sub-cooled liquid and returning to the source.

Preferably, the stream of sub-cooled liquid is a stream of sub-cooled liquid nitrogen. The stream of sub-cooled liquid is preferably taken from and returned to a heat exchanger in which liquid nitrogen is sub-cooled.

Preferably, a reboiler is associated with a lower region of the stripping column. The reboiler is preferably heated by a condensing stream of different fluid from that which forms the stream of sub-cooled liquid. The condensing stream preferably comprises a vaporous mixture of argon and oxygen. The vaporous mixture is preferably taken from the second rectification. Resulting argon-oxygen condensate is preferably returned to the second rectification.

The second rectification is preferably performed by rectifying the said argon-containing stream in a first part-column, withdrawing a vapour stream from an upper region of the first part-column, introducing the vapour stream into a lower region of a second part-column, rectifying the vapour stream and the second part-column, condensing vapour in a condenser associated with an upper region of the second part-column, employing at least part of the resulting condensed vapour as reflux in the second part-column, and transferring a liquid stream from the lower region of the second part-column to the upper region of the first part-column. In such examples, the vaporous mixture of argon and oxygen is preferably taken from the vapour stream flowing from the first part-column to the second part-column, and the resulting condensed mixture of oxygen and argon is preferably returned to the liquid stream being transferred from the second part-column to the first part-column.

The method and apparatus according to the invention offer advantages over those disclosed in the prior documents discussed above. By using a stream of sub-cooled liquid to cool the stripping column condenser, the need for a bath in which the condenser is partially immersed is avoided, while at the same time problems in achieving a uniform introduction of a two-phase mixture into the cooling passages of the condenser are also avoided. Thus the stripping column condenser may be of a design which permits the sub-cooled liquid to flow directly from a source thereof without there being an intermediate vessel in which the sub-cooled liquid is held upstream of its entry into the stripping column condenser. Simplicity of mechanical design is also aided by employing in the stripping column reboiler a fluid different from that which cools the stripping column condenser. Indeed, little extra pipework is required if the condensing fluid is taken from and returned to the second rectification.

BRIEF DESCRIPTION OF THE DRAWINGS

A method and apparatus according to the invention will now be described by way of example with reference to the accompanying drawings, in which.

The drawings are not to scale.

DETAILED DESCRIPTION OF THE INVENTION

Figure 1:
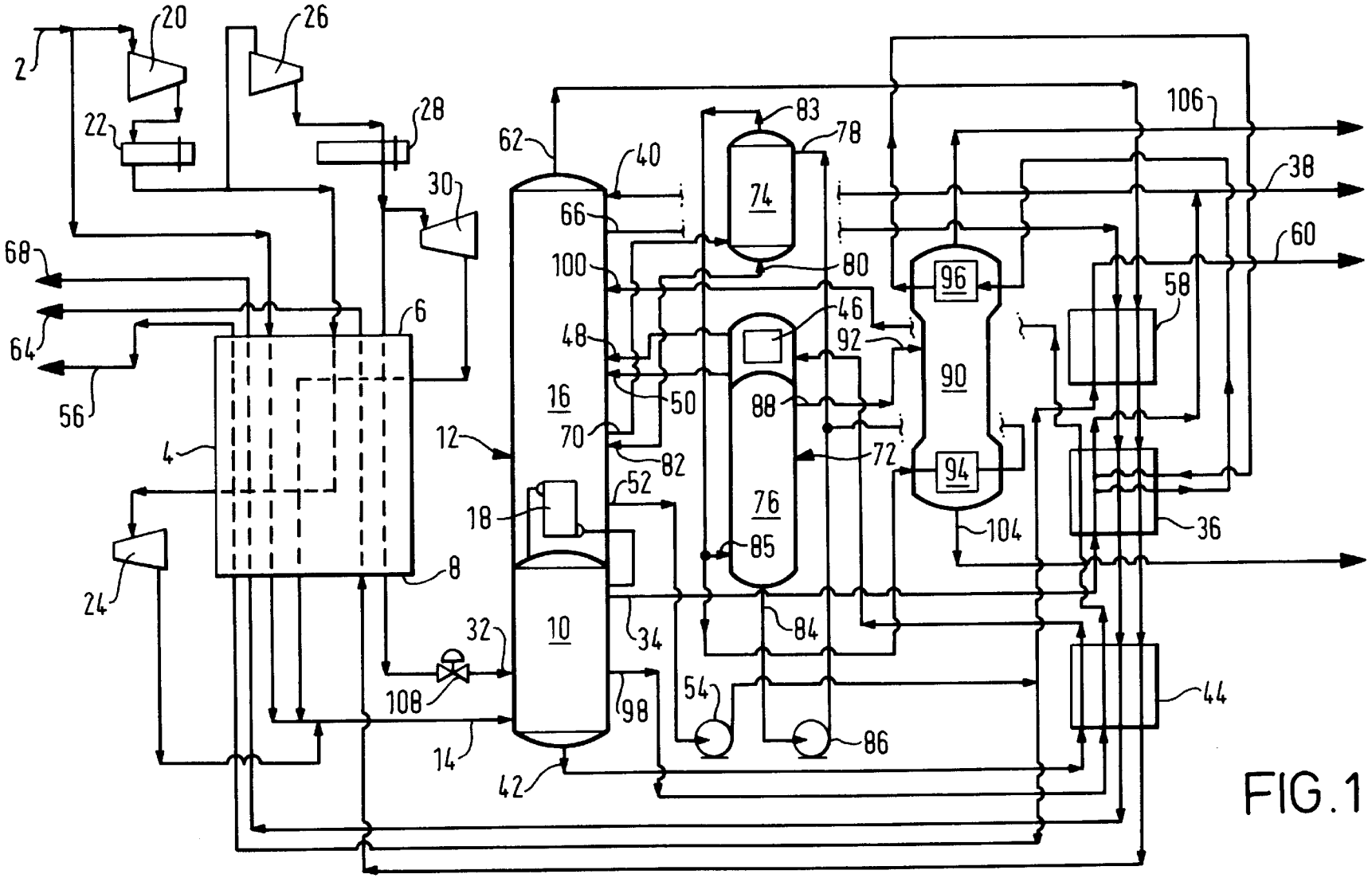
FIG. 1 is a schematic flow diagram of an air separation plant.

The plant shown in FIG. 1 the drawings has an inlet conduit 2 for a stream of compressed, pure air, typically at a pressure in the range of 5 to 6 bar. The stream of air is formed by conventional means. For example, it may be compressed to the requisite pressure in a main compressor (not shown), cooled to remove heat of compression and to reduce its temperature to a level above freezing point but below ambient temperature, and subjected to adsorptive purification so as to remove water vapour, carbon dioxide, and, if desired, hydrocarbons therefrom. The stream of air flowing into the conduit 2 is divided into two subsidiary streams. A first subsidiary stream flows through a main heat exchanger 4 from its warm end 6 to its cold end 8 and is introduced through an inlet 14 into a higher rectification column 10 forming part of a double rectification column 12. The double rectification column 12 also includes a lower pressure rectification column 16 and a condenser-reboiler 18 placing the top of the higher pressure rectification column 10 in heat exchange relationship with the bottom of the lower pressure rectification column 16.

The other subsidiary stream flows into a first booster-compressor 20 and is typically compressed therein to a pressure in the range of 20 to 25 bar. The resultant, further compressed, air stream is cooled in an aftercooler 22 so as to remove heat of compression therefrom. The resultant cooled, subsidiary stream of air is further divided. One part flows through the main heat exchanger 4 from its warm end 6 to an intermediate region thereof. This stream is withdrawn from the intermediate region of the main heat exchanger 4 and is expanded in a first expansion turbine 24. The expanded stream of air leaves the turbine 24 at a pressure approximately equal to that at the bottom of the higher pressure rectification column 10 and at a temperature approximately equal to its saturation temperature. The stream of expanded air is mixed with the first subsidiary stream of air intermediate the cold end 8 of the main heat exchanger 4 and the inlet 14 to the column 10.

That part of the air flow from the aftercooler 22 which is not passed to the intermediate region of the main heat exchanger 4 flows to a second booster compressor 26 in which its pressure is typically raised to a pressure in the order of 50 bar. The resulting compressed air stream flows from the second booster compressor 26 through an aftercooler 28 and its temperature is thereby returned to approximately ambient temperature. Downstream of the aftercooler 28 this flow of air is divided into two parts. One part flows at ambient temperature into a second expansion turbine 30 and is expanded therein to approximately the pressure at the bottom of the higher pressure rectification column 10. The resulting expanded air stream is introduced into the main heat exchanger 4 at a region intermediate its warm end 6 and its cold end 8 and flows therethrough in the direction of its cold end 8. The resulting cooled stream of air at approximately its saturation temperature is mixed with the other streams of air that enter the higher pressure rectification column 10 through its inlet 14. The temperature at which the air leaves the second expansion turbine 30 is typically the same as or similar to that at which the air enters the first expansion turbine 24. These temperatures may be in the range of 130 to 180 K.

That part of the air which does not flow through the second expansion turbine 30 from downstream of the aftercooler 28 flows instead through the main heat exchanger 4 from its warm end 6 to its cold end 8 and is thereby cooled to a temperature such that on being reduced sufficiently in pressure it liquefies. This stream of air flows from the cold end 8 of the main heat exchanger 4 through a throttling valve 108 and is thereby reduced in pressure to approximately that of the higher pressure rectification column 10. The stream of air accordingly liquefies. The resultant liquid stream of air flows into the higher pressure rectification column 10 through an inlet 32 at a level above that of the inlet 14.

The higher pressure rectification column 10 is provided with liquid-vapour contact devices (not shown) which may take the form of structured or random packing or of sieve trays. The liquid-vapour contact devices enable ascending vapour to make intimate contact with a descending liquid stream and as a result mass transfer takes place and the air is separated. Nitrogen vapour flows from the top of the higher pressure rectification column 10 into the condenser-reboiler 18 and is condensed therein. A first part of the resulting condensate is employed as reflux in the column 10. Another part of the liquid nitrogen condensate flows from an outlet 34 through a heat exchanger 36 and is thereby sub-cooled. The resulting sub-cooled liquid nitrogen is divided into two parts. One part is taken as a liquid nitrogen product via a conduit 38. The other part flows through a throttling valve (not shown) so as to reduce its pressure to approximately that at the top of the lower pressure rectification column 16 (i.e. approximately 1.3 bar) and is introduced through an inlet 40 into the top of the column 16 and thereby serves as reflux in the column 16.

An oxygen-enriched liquid stream is withdrawn from the bottom of the higher pressure rectification column 10 through an outlet 42 and is sub-cooled by passage through a heat exchanger 44. The resulting sub-cooled oxygen-enriched liquid stream flows through a throttling valve (not shown) into a condenser 46 of the thermosiphon kind which is associated with the rectification of an argon-oxygen stream withdrawn from the lower pressure rectification column 16 as will be described below. The throttling valve (not shown) at the inlet to the condenser 46 reduces the pressure of the liquid flowing therethrough to approximately that of the lower pressure rectification column 16. A part of the liquid entering the condenser 46 is vaporised and the resulting vapour flows into the lower pressure rectification column 16 through an inlet 48. A stream of unvaporised oxygen-enriched liquid is withdrawn from the condenser 46 and flows into the lower pressure rectification column through an inlet 50.

A liquid stream having approximately the same composition as air is withdrawn from the higher pressure rectification column 10 through an outlet 98, is sub-cooled by passage through the heat exchangers 44 and 36, in sequence, and is introduced into the lower pressure rectification column 16 through an inlet 100.

Fluid entering the lower pressure rectification column 16 through the inlets 48, 50 and 100 is separated therein into oxygen and nitrogen. Typically, the lower pressure rectification column 16 contains a low pressure drop random or structured packing so as to effect intimate contact between ascending vapour and descending liquid. The ascending vapour is created by operation of the condenser-reboiler 18 to boil a part of a volume of liquid oxygen that collects at the bottom of the column 16. This boiling is performed by indirect heat exchange with the condensing nitrogen vapour. A liquid oxygen stream is withdrawn from a bottom region of the lower pressure rectification column 16 through an outlet 52 by means of a pump 54 which raises its pressure to a chosen value. The resulting pressurised liquid oxygen stream is divided into two parts. One part flows through the main heat exchanger 4 from its cold end 8 to its warm end 6 and, if at a pressure below its critical pressure, is thereby vaporised. (If above its critical pressure, the oxygen remains as a supercritical fluid.) A pressurised gaseous oxygen product stream at approximately ambient temperature flows out of the warm end 6 of the main heat exchanger 4 through a conduit 56. The other part of the pressurised liquid oxygen stream is sub-cooled by passage through a heat exchanger 58 and is taken as a liquid oxygen product via a conduit 60.

A nitrogen stream is withdrawn from the top of the lower pressure rectification column 16 through an outlet 62 and flows in sequence through the heat exchangers 58, 36 and 44 thereby providing cooling therefor. The resultant stream of nitrogen flows through the main heat exchanger 4 from its cold end 8 to its warm end 6 and is thereby warmed to ambient temperature. A low pressure nitrogen product is withdrawn from the warm end of the main heat exchanger 4 through a conduit 64. An impure nitrogen stream is also withdrawn from the lower pressure rectification column 16 through an outlet 66 at a level a little below the top of the column 16. The impure nitrogen stream flows through the heat exchangers 58, 36 and 44 in sequence, thereby providing cooling for them. The resulting impure nitrogen stream flows through the main heat exchanger 4 from its cold end 8 to its warm end 6, thereby being warmed to approximately ambient temperature. An impure nitrogen stream is withdrawn from the warm end 6 of the main heat exchanger 4 through a conduit 68 and may, for example, be used in the regeneration of adsorbent beds (not shown) in the unit (not shown) that purifies the incoming air.

As is well known in the art, in the lower pressure rectification column 16 there are created regions of relatively high argon concentration having regard to that of the incoming air. These regions are formed at intermediate locations of the column 16. An oxygen stream typically containing from 6 to 14% by volume of argon and typically up to 200 parts per million of nitrogen impurity is withdrawn from one such region through an outlet 70 and is introduced into a second or argon rectification column 72 which is split into two parts 74 and 76. Both part-columns 74 and 76 contain low pressure drop random or structured packing (not shown) so as to effect contact between rising vapour and descending liquid. The stream withdrawn from the outlet 70 is actually introduced into the bottom of the part-column 74. It is contacted therein with a liquid stream which is introduced through an inlet 78. An impure liquid oxygen stream is withdrawn from the bottom of the parts column 74 through an outlet 80 and is returned to the lower pressure rectification column 16 through an inlet 82. A vapour stream, enriched in argon, is withdrawn from the top of the part-column 74 through an outlet 83 and is introduced into the bottom of the other part-column 76 through an outlet 85. The top of the part-column 76 is associated with the condenser 46. Essentially oxygen-free argon separated from the vapour introduced through the inlet 85 is condensed in the condenser 46 by indirect heat exchange with vaporising oxygen-enriched liquid. One part of the resulting argon condensate is returned to the top of the part-column 76 as reflux. A liquid is withdrawn from the bottom of the part-column 76 through an outlet 84 at its bottom and is sent by a pump 86 to the top of the upper part-column 74, forming the liquid that is introduced into the top thereof through the inlet 78. The part-columns 74 and 76 function as a single rectification column for the separation of argon from oxygen. The part-column 74 forms the first part of the argon-oxygen separation to produce a vapour stream which is richer in argon, and the separation is completed in the other part-column 76. If desired, the two part-columns 74 and 76 can be replaced by a single column.

An essentially oxygen-free argon product still containing nitrogen impurity is withdrawn from the top of the part-column 76 through an outlet 88 and is introduced into an intermediate region of a stripping column 90 through an inlet 92. The stripping column 90 contains liquid-vapour contact devices (not shown) such as sieve trays or structured or random packing whereby descending liquid is contacted with ascending vapour. As liquid descends the stripping column 90 so it is progressively stripped of the nitrogen impurities by ascending vapour. An essentially nitrogen-free argon fraction thus collects at the bottom of the stripping column 90. This liquid is partially boiled by means of a reboiler 94. Thus, the necessary stripping vapour flow upwardly through the column 90 is created. An argon-nitrogen vapour mixture is condensed at the top of the column 90 in a condenser 96, thereby creating a reflux flow for the column 90.

A vaporous stream of a mixture of argon and oxygen is withdrawn from that flowing from the outlet 83 of the part column 74 to the inlet 85 of the other part column 76. In order to provide heating for the reboiler 94, the vapour stream so withdrawn is condensed by indirect heat exchange with boiling liquid in the reboiler 94. The resultant condensate flows to either the downstream side (as shown) or the upstream side of the pump 86 and is thus mixed with the liquid flowing from the outlet 84 of the part-column 76 to the inlet 78 to the part-column 74.

Figure 2:
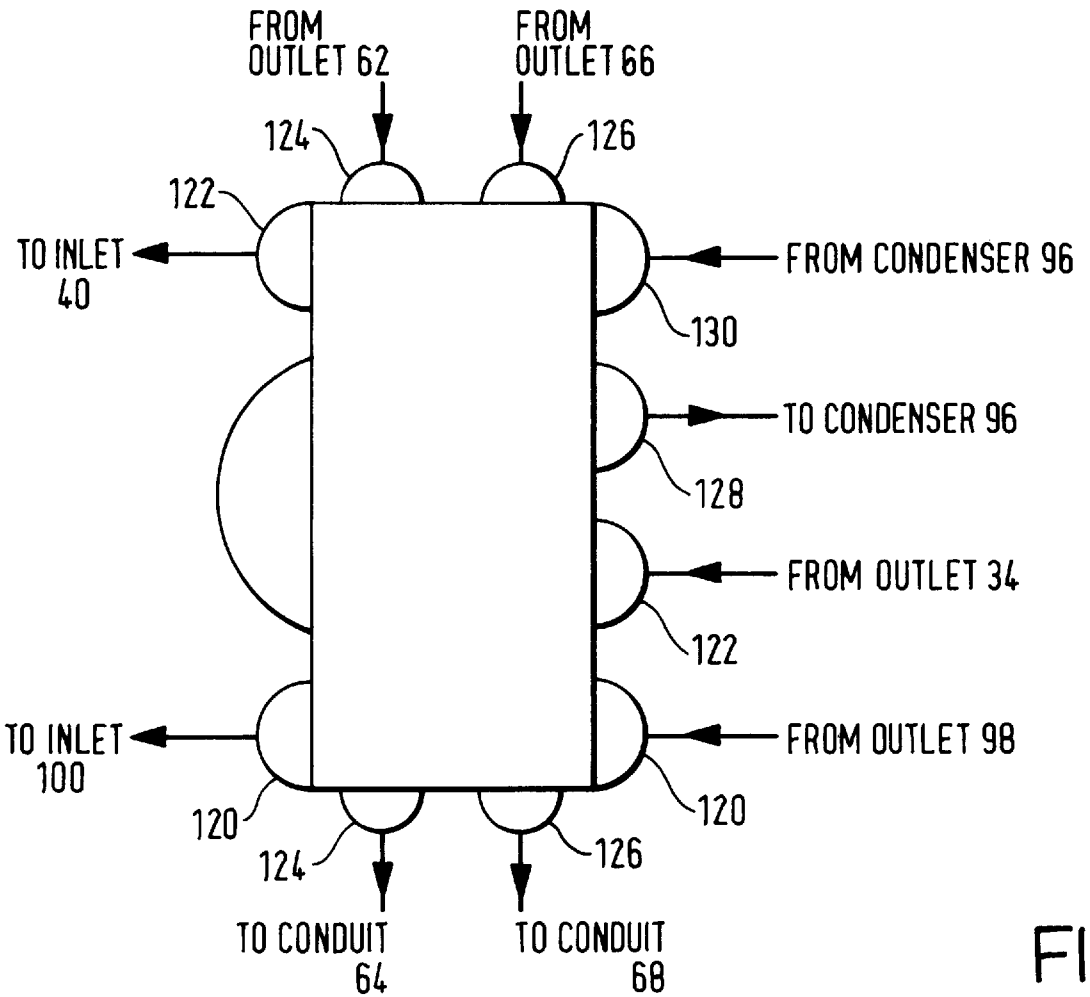
FIG. 2 is a schematic diagram of a sub-cooler forming part of the plant shown in FIG. 1.

A stream of sub-cooled liquid nitrogen is withdrawn from a first, higher temperature, intermediate region of the heat exchanger 36 and is passed through the condenser 96 so as to provide the cooling necessary to condense vapour therein. The sub-cooled liquid is raised in temperature typically by 2 or 3 K, but not by an amount sufficient to remove all the sub-cooling. The resulting warmed liquid nitrogen is returned from the condenser 96 to a second, lower temperature, intermediate region of the heat exchanger 36. The heat exchanger 36 is illustrated in more detail in FIG. 2 of the accompanying drawings. The heat exchanger 36 has passes 120, 122, 124 and 126 for, respectively, the stream of liquid air withdrawn from the higher pressure rectification column 10 through the outlet 98, the stream of liquid nitrogen withdrawn from the top of the rectification column 10 through the outlet 34, and the streams of nitrogen withdrawn from the lower pressure rectification column 16 through the outlet 62 and 66. Typically, the stream of liquid nitrogen enters the pass 122 at a temperature of 94.5 K and leave the pass 122 at a temperature of 22 K. A stream of sub-cooled liquid nitrogen is withdrawn from the pass 122 through an outlet 128 at a temperature of 84.5 K and passes to the condenser 96 shown in FIG. 1. A stream of sub-cooled liquid nitrogen is returned from the condenser 96 to an inlet 130 to the pass 122 at a temperature in the order of 86 K. The effect of withdrawing a part of the sub-cooled nitrogen from an intermediate region of the heat exchanger 36 is slightly to raise the temperature at which the liquid air stream leaves the heat exchanger 36. The effect is small, however, because the flow of liquid nitrogen through the condenser 96 is generally less than 5% of that through the pass 122.

Referring again to FIG. 1, an essentially oxygen-free and nitrogen-free argon stream is withdrawn in liquid state from the bottom of the stripping column 90 through an outlet 104 and is passed to storage. The top of the stripping column 90 communicates with a purge conduit 106 whereby any relatively low volatility impurities which are not condensed in the condenser 96 evented from the stripping column 90.

If desired, the expansion turbines 24 and 30 may each be coupled to and hence employed to drive a different booster-compressor. For example, the expansion turbine 24 may be coupled to the booster-compressor 20, and the expansion turbine coupled to the booster-compressor 26. Alternatively, the expansion turbines 24 and 30 may be employed to generate electrical power, which, if desired, can be used to drive one or more compressors forming part of the illustrated plant.

I claim:

1. A method of separating air, comprising:

subjecting a flow of air to a first rectification to thereby separate an oxygen fraction and a nitrogen fraction from the air and thereby to produce in a rectification column, a region having argon, oxygen and a nitrogen impurity;

withdrawing from the region, an argon-containing stream comprising said argon, oxygen, and, nitrogen impurity;

subjecting the argon-containing stream to a second rectification and thereby separating from it an impure argon fraction containing said nitrogen impurity;

introducing a stream of the argon fraction into a stripping column and stripping said nitrogen impurity from said argon fraction, thereby to produce an argon-nitrogen vapour mixture; and condensing in a condenser, associated with an upper region of the stripping column, said argon-nitrogen vapour mixture by indirect heat exchange with a stream of sub-cooled liquid, the stream of sub-cooled liquid passing out of said indirect heat exchange remaining in a sub-cooled state.

2. The method as claimed in claim 1, in which the stream of sub-cooled liquid is a stream of sub-cooled liquid nitrogen.

3. The method as claimed in claim 1, in which the stream of sub-cooled liquid is taken from and returned to a heat exchanger in which liquid nitrogen is sub-cooled.

4. The method as claimed in claim 1, in which a reboiler is associated with a lower region of the stripping column, and the reboiler is heated by a condensing stream of different fluid from that which forms the stream of sub-cooled liquid.

5. The method as claimed in claim 4, in which the condensing stream comprises a vaporous mixture of argon and oxygen and is taken from and returned to the second rectification.

6. The method as claimed in claim 5, in which the second rectification is performed by:

rectifying the said argon-containing stream in a first part-column;

withdrawing a vapour stream from an upper region of the first part-column;

introducing the vapour stream into a lower region of a second part-column, rectifying the vapour stream in the second part-column;

condensing vapour in a condenser associated with an upper region of the second part-column;

employing at least part of the resulting condensed vapour as reflux in the second part-column;

transferring a liquid stream from the lower region of the second part-column to the upper region of the first part-column;

taking the vaporous mixture of argon and oxygen from the vapour stream flowing from the first part-column to the second part-column; and returning the resulting condensed mixture of oxygen and argon to the liquid stream being transferred from the second part-column to the first part-column.

7. An apparatus for separating air, comprising:

a first rectification column for separating a flow of air into an oxygen fraction and nitrogen fraction;

the first rectification column having an outlet for an argon-containing stream comprising argon, oxygen and, as an impurity, nitrogen;

a second rectification column for separating from the argon-containing stream an impure argon fraction containing nitrogen;

a stripping column for stripping nitrogen impurity from a stream of the impure argon fraction and having a condenser associated with an upper region of the stripping column; and a flow path through the condenser for a stream of sub-cooled liquid extending from a source of the sub-cooled liquid and returning to the source.

8. The apparatus as claimed in claim 7, in which said source is a source of sub-cooled liquid nitrogen.

9. The apparatus as claimed in claim 7, in which said source is a heat exchanger.

10. The apparatus as claimed in claim 7, additionally including a reboiler associated with a lower region of the stripping column, and means for heating the reboiler with a condensing stream of a fluid different from that which, in use, forms the stream of sub-cooled liquid.

* * * * *